US006238084B1

(12) United States Patent
Blotky et al.

(10) Patent No.: US 6,238,084 B1
(45) Date of Patent: May 29, 2001

(54) WATCH OR OTHER JEWELRY ARTICLE WITH REPLACEABLE ELECTRONIC IMAGES

(75) Inventors: Randolph M. Blotky; Gregory B. Thagard, both of Los Angeles; John H. Dargan, Palos Verdes Estates, all of CA (US)

(73) Assignee: Time Warner Entertainment Co., L.P., Burbank, CA (US)

( * ) Notice: Subject to any disclaimer, the term of this patent is extended or adjusted under 35 U.S.C. 154(b) by 0 days.

(21) Appl. No.: 09/300,663

(22) Filed: Apr. 27, 1999

(51) Int. Cl.[7] ..... G04B 37/00
(52) U.S. Cl. ..... 368/294; 368/10
(58) Field of Search ..... 368/10, 223, 281–296

(56) References Cited

U.S. PATENT DOCUMENTS 4,525,077 * 6/1985 Ketner ..... 368/77
5,214,622 * 5/1993 Nemoto et al. ..... 368/10
5,224,078 * 6/1993 Mallin ..... 368/223
5,355,352 * 10/1994 Kobayashi et al. ..... 368/281

FOREIGN PATENT DOCUMENTS

506007 * 9/1992 (EP) .

* cited by examiner

*Primary Examiner*—Bernard Roskoski
(74) *Attorney, Agent, or Firm*—Gottlieb, Rackman & Reisman, P.C.

(57) ABSTRACT

A decorative article such as a wristwatch, pin or pendant having a case with a substantial visible surface area is provided with a display mounted on said area and an electrical circuit arranged to provide signals for said display so that a predetermined image appears on, or is displayed by, said display. One or more external members are also provided which can be selectively mounted on the case. Imbedded in each external member is a memory storing digital imaging data. When a particular external member is mounted on the case, its memory is accessed by the electrical circuit and the corresponding data is retrieved and used to generate the image on the display. Changing the external member to a different member results in a different image being displayed on the display.

2 Claims, 2 Drawing Sheets

WATCH OR OTHER JEWELRY ARTICLE WITH REPLACEABLE ELECTRONIC IMAGES

BACKGROUND OF THE INVENTION

1. Field of Invention

This invention pertains to decorative articles such as watches, pins, pendants and other similar jewelry which have a relatively large visible surface used to display an ornamental design. More particularly, the present invention pertains to a decorative article bearing an ornamental design generated by an electronic display.

2. Description of the Prior Art

There are many different kinds of decorative articles on the market that have a surface with an ornamental design. For example, wristwatches sometimes have an ornamental design on their dials or bezels. Pins or pendants are available with a surface bearing an ornamental design. However, in all these cases the ornamental design is imbedded or otherwise affixed to the surface and therefore it is generally static in the sense that it cannot be changed.

Attempts have been made to provide jewelry articles with means for changing at least some of their ornamental aspects. For example, pins and pendants equipped with a small window which accept the wearer's choice of a photograph and watches with exchangeable plastic rings of different colors are available. However, even in these articles, the degree of customization and variability is still very limited.

OBJECTIVES AND SUMMARY OF THE INVENTION

It is an objective of the present invention to provide a decorative article with means for changing its appearance at will.

A further objective is to provide a decorative article having a display that can be changed electronically.

Yet another objective is to provide an article having at least one ornamental design that can be changed easily by using electronic circuitry built into the article and having a replaceable memory element.

Other objectives and advantages of the invention will become apparent from the following description.

Briefly, a decorative article such as a wristwatch or a pendant is provided which has an electronic display and an electronic circuit adapted to drive the display. The article also includes an element, preferably an external element, such as a bezel which mates with a socket on the article. Imbedded in the external element is an electronic memory containing imaging data. When the external element is connected to its socket, the electronic circuit accesses the imaging data and generates an image on the display in accordance with this data. Therefore, the image displayed on the jewelry article can be readily changed by replacing the external element with another element having a memory with different imaging data. The displayed image can be ornamental or informative, incorporating various alphanumeric characters or graphic elements.

DETAILED DESCRIPTION OF THE INVENTION

Figure 1:
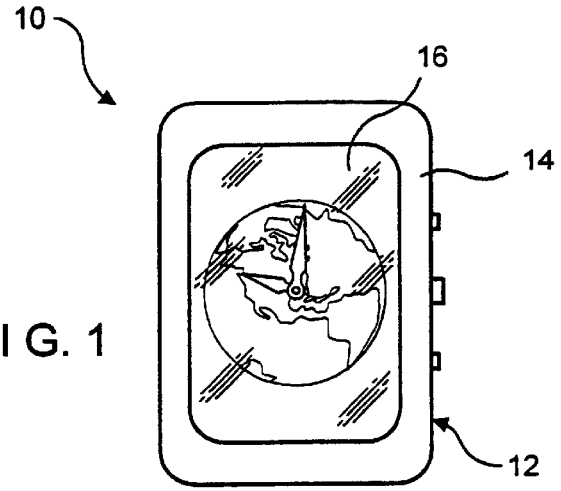
FIG. 1 shows a plan view of a wristwatch constructed in accordance with this invention.
Figure 2:
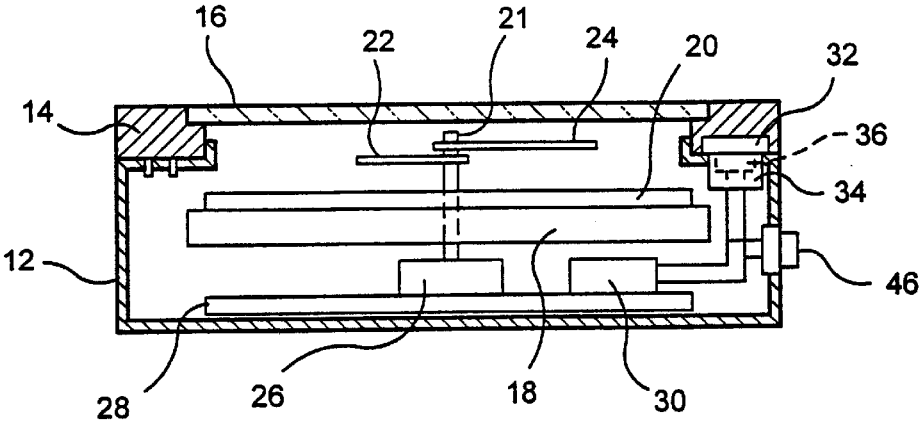
FIG. 2 shows a somewhat diagrammatic cross-sectional view of the wristwatch of FIG. 1.

Referring now to FIGS. 1 and 2, a wristwatch 10 constructed in accordance with this invention comprises a case 12, a bezel 14, and a transparent crystal 16. Disposed under the crystal 16 is a dial 18 which is provided with a display 20. The display element 20 is, for example, an LCD type display. LCD displays suitable for this purpose are made, for example, by Micro Display Corporation of Richmond, Calif. Alternatively, display 20 may be made from a light emitting polymer material, available from Cambridge Display Technology of Cambridge, U.K. A stem 21 extends through the dial 18 and supports two hands 22, 24.

Inside case 12 there is provided a movement 26 which drives the hands 22, 24 in the usual manner, to indicate the current time. The movement 26 is supported by a board 28. The movement 26 may include electronic oscillators and a stepping motor.

Also mounted on the board 28 is an electric circuit 30 which may be an IC. This electrical circuit 30 is used to generate the signals required to drive the display 20. Circuit 30 may be incorporated into the movement 26 but is shown here as being a separate element for the sake of clarity. Also disposed in the case 12 is a disposable battery which powers the movement 26 and electrical circuit 30. This battery has been omitted from the drawings for the sake of simplicity.

The bezel 14 is not fixed to the case 12 but is provided with attaching means which allow the bezel 14 to be detached and reattached at will. For example, the bezel 14 may be friction fit over the case 12. Inside the bezel 14 there is an electronic memory 32 such as a read-only memory (ROM). The memory 32 is used to store imaging data.

At the interface with the bezel 14, case 12 is provided with a socket 34. The bezel 14 has a matching plug 36 coupled to the memory 32. The socket 34 is connected to the circuit 30. The socket 34 and plug 36 are arranged so that when the bezel 14 is attached to case 12, the ROM 32 is automatically connected to the circuit 30.

Figure 3:
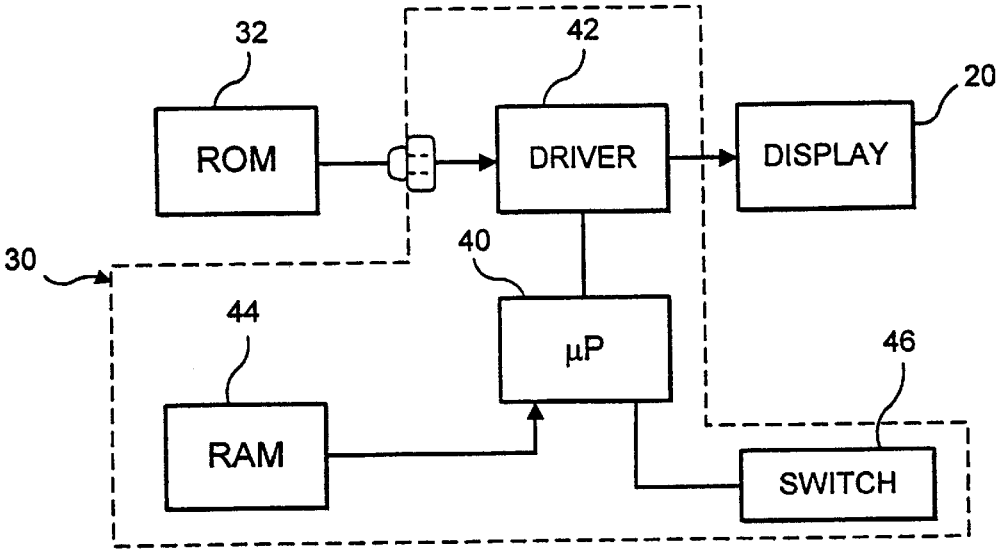
FIG. 3 shows a block diagram of an electronic circuit provided inside the wristwatch of FIGS. 1 and 2.

FIG. 3 shows the electrical circuit 30 which includes a microprocessor 40 and a driver 42. The microprocessor 40 is arranged to receive the imaging data from the memory 32 when they are interconnected as described above. The microprocessor 40 sends control signals to the driver 32. The driver 32 is responsive to these control signals to activate display 20 causing the display 20 to show a particular image corresponding to the imaging data from memory 32. The memory 32 can be easily changed by replacing bezel 14 with another bezel having substantially the same dimensions and a memory with different imaging data.

The electrical circuit 30 may further be provided with its own memory 44. This memory 44 (for example, a RAM) may be used to provide programming instructions for the microprocessor 40. In addition, memory 44 may also be used to provide imaging data defining a default image. This default image is shown on the display screen 20 while the bezel 14 is being changed, or if either the bezel 14 or the memory 32 are defective.

Advances in memory technology make it possible to store data for several images in a single memory 32. Therefore, the circuitry shown in FIG. 3 may also be used to show several images in sequence. The order in which the images are shown may be determined by the microprocessor 40. Alternatively, or in addition, a switch 46 may be provided on case 12. The wearer can thus change the current image being shown on the display 20 to another image by activating the switch 46.

Figure 4:
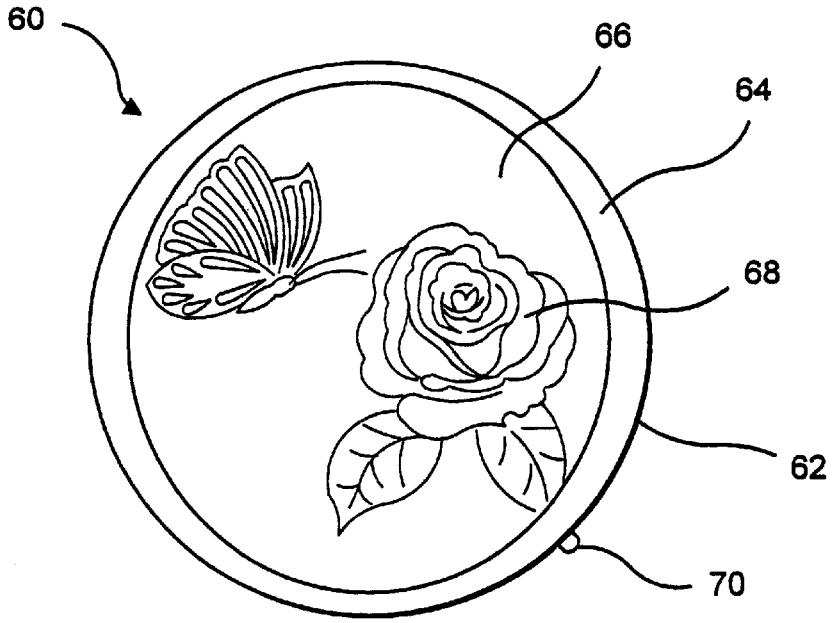
FIG. 4 is a plan view of a pendant constructed in accordance with this invention and showing a first image.
Figure 5:
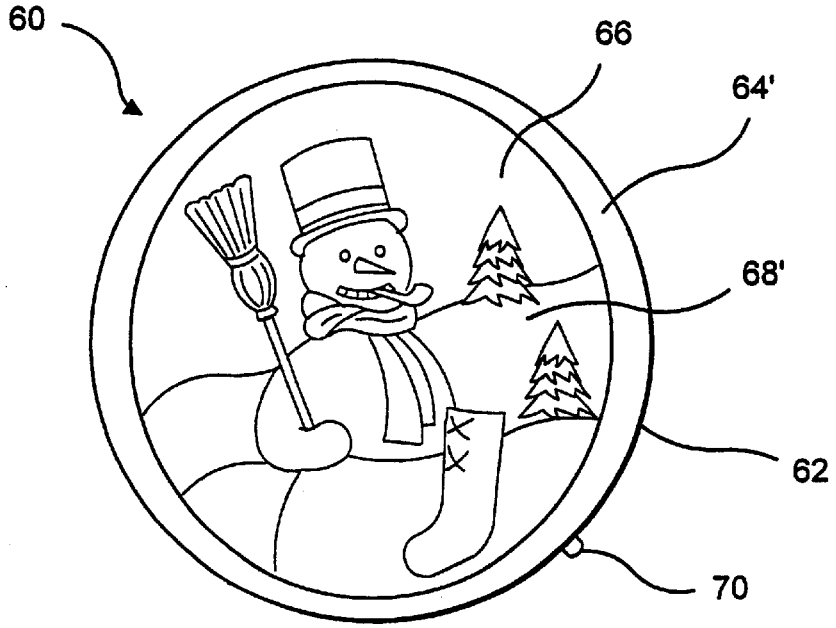
FIG. 5 is a plan view of the pendant of FIG. 4 showing a second image.

The invention is shown in FIGS. 1–3 as it applies to a wristwatch. However, the invention may be used in other decorative articles. For example, FIGS. 4 and 5 show a pendant pin 60 having a case 62, a bezel 64 and a display 66. The pendant 60 may have on its back an attachment member for attaching the pendant to an apparel such as a chain or an article of clothing so that the pendant can be worn by a person. Bezel 64 holds a memory (not shown) used to store imaging data. An electronic circuit (not shown ) similar to the electrical circuit 30 in FIGS. 2 and 3 is embedded or otherwise attached to the case 62. Just as with wristwatch 10, the image shown on the display 66 is determined by the imaging data in the memory disposed in the bezel 64. In FIG. 4, for example, the data defines an image 68 of a flower.

The wearer of the pendant or pin 60 may decide to change image 68 to a different image to match her outfit, to celebrate a holiday, and so on. In order to change the image 68, the wearer replaces the bezel 64 with a different bezel 64', as shown in FIG. 5. As a result, the display screen 66 now shows a new image 68'. Preferably, bezels 64 and 64' have the same physical dimensions but may have different colors.

The pendant 60 may also display several images if the memory in the bezels 64, 64' is large enough to hold sufficient data for this purpose. The images may change automatically, and/or the wearer may change these images by activating a button 70.

The memory holding the imaging data may be stored in other removable members which may be selectively engaged with and disengaged from watch 10 or pendant 60 as well. For example, a flash card may be used as the memory.

The principles of the present invention may be applied to other articles as well. For example, a name tag may comprise a removable member similar to that of pendant 60 of FIGS. 4 and 5. The name tag can then display various alphanumeric characters to identify the wearer and/or his association. The name tag can then be switched from one wearer to another wearer or alternatively the same wearer can use the tag for different functions by changing its removable memory.

Numerous modifications may be made to this invention without departing from its scope as defined below.

We claim:

1. A wristwatch comprising:

a case;

a time indicator disposed in said case to indicate a current time;

an electronic display attached to said case and arranged so that it is visible when worn by a user; a controller disposed in said case and adapted to generate signals for said electronic display being responsive to said signals to show an image; and a bezel containing a removable memory mounted on said case and storing imaging data, said controller being arranged to selectively access said imaging data to retrieve said imaging data and to generate said signals in response to said imaging data.

2. The wristwatch of claim 1, wherein the removeable bezel is constructed to selectively be removed and remounted on said case such that the imaging data may be modified and stored to the memory.

* * * * *